US009546475B2

(12) United States Patent
Lu

(10) Patent No.: US 9,546,475 B2
(45) Date of Patent: Jan. 17, 2017

(54) VALVE MEMBER ASSEMBLY

(71) Applicant: Watts Water Technologies, Inc., North Andover, MA (US)

(72) Inventor: John D. Lu, Malden, MA (US)

(73) Assignee: Watts Water Technologies, Inc., North Andover, MA (US)

( * ) Notice: Subject to any disclaimer, the term of this patent is extended or adjusted under 35 U.S.C. 154(b) by 37 days.

(21) Appl. No.: 14/625,807

(22) Filed: Feb. 19, 2015

(65) Prior Publication Data

US 2015/0233096 A1 Aug. 20, 2015

Related U.S. Application Data

(60) Provisional application No. 61/941,957, filed on Feb. 19, 2014.

(51) Int. Cl.

| | |
|---|---|
| ***E03B 7/12*** | (2006.01) |
| ***E03C 1/10*** | (2006.01) |
| ***E03B 7/07*** | (2006.01) |

(52) U.S. Cl.

CPC ..... *E03C 1/104* (2013.01); *E03B 7/077* (2013.01); *Y10T 137/3294* (2015.04); *Y10T 137/7932* (2015.04); *Y10T 137/7933* (2015.04)

(58) Field of Classification Search

CPC .... E03C 1/104; E03B 7/077; Y10T 137/3294; Y10T 137/7932; Y10T 1137/7933

See application file for complete search history.

(56) References Cited

U.S. PATENT DOCUMENTS

| | | | | |
|---|---|---|---|---|
| 3,189,037 | A | 6/1965 | Callejo | |
| 4,667,697 | A * | 5/1987 | Crawford | F16K 15/025 137/315.33 |
| 5,125,429 | A | 6/1992 | Ackroyd et al. | |
| 5,520,367 | A * | 5/1996 | Stowers | F16K 24/02 137/218 |
| 5,551,473 | A | 9/1996 | Lin et al. | |
| 5,901,735 | A * | 5/1999 | Breda | E03C 1/023 137/218 |
| 6,123,095 | A | 9/2000 | Kersten et al. | |
| 6,170,510 | B1 * | 1/2001 | King | B60K 15/03519 137/202 |
| 7,934,515 | B1 | 5/2011 | Towsley et al. | |
| 2004/0107993 | A1 | 6/2004 | Stephens | |
| 2005/0092364 | A1 * | 5/2005 | Furuya | F16K 17/196 137/202 |

(Continued)

OTHER PUBLICATIONS

Appolo Valves PVB4A Series Installation, Operation, and Maintenance Manual, copyright May 2009.

(Continued)

*Primary Examiner* — Craig Schneider
*Assistant Examiner* — Kevin Barss
(74) *Attorney, Agent, or Firm* — Adler Pollock & Sheehan P.C.; George N. Chaclas, Esq.; Daniel J. Holmander, Esq.

(57) ABSTRACT

A valve member assembly includes a housing, a check valve assembly, and a float valve assembly. The housing is a cup, a retainer and a bonnet releasably secured together. The check valve assembly is positioned within the cup, and the float valve assembly is positioned between the bonnet and the retainer. The valve member assembly can be easily assembled and inserted into a valve body.

19 Claims, 16 Drawing Sheets

(56) References Cited

U.S. PATENT DOCUMENTS

| | | | | |
|---|---|---|---|---|
| 2006/0196542 | A1* | 9/2006 | Yen | F16K 15/026 137/218 |
| 2007/0193633 | A1 | 8/2007 | Howell et al. | |

OTHER PUBLICATIONS

Appolo Valves Installation, Operation and Maintenance Manual for Model PVB4A ½"-2" Pressure Vacuum Breaker Backflow Preventer, dated Jan. 11, 2012.

Watts Water Technologies Company Brochure ES LF800M4QT for Health Hazard Applications Lead Free Series LF8 M4QT Anti-Siphon Vacuum Breakers Sizes ½"-2" coyright 2013.

Conbraco BFMMPVB Maintenance Manual for Series 4V-500 ½"-2" Pressure Type Vacuum Breaker, Apr. 2002, Conbraco Industries, Inc., Matthews, North Carolina 28106.

* cited by examiner

VALVE MEMBER ASSEMBLY

CROSS-REFERENCE TO RELATED APPLICATION

This application claims priority to U.S. Provisional Patent Application No. 61/941,957, filed Feb. 19, 2014, which is incorporated herein by reference.

TECHNICAL FIELD OF THE DISCLOSURE

The present disclosure relates to a valve member assembly and, more specifically, to a vacuum pressure breaker valve including a removable valve member assembly.

BACKGROUND OF THE DISCLOSURE

Pressure vacuum breaker (PVB) valves are used to protect against back-siphonage in a wide variety of conditions such as in industrial plants, laboratories, laundries, swimming pools and lawn sprinkler systems. PVB valves prevent back-siphonage of water into a potable water supply. The PVB valve includes a one-way check valve which closes tightly when flow through the valve drops to zero, and an air relief valve that opens to break the siphon when pressure drops to 1 psi, thereby preventing back-siphonage. The PVB valve may also include a spring-loaded relief valve that, in the event of exposure to freezing temperatures, opens to release freezing water and protect the PVB body and internal components from damage. As the temperature increases above freezing, the relief valve automatically closes.

SUMMARY OF THE DISCLOSURE

What is still desired is a new and improved PVB valve and, in particular, a new and improved valve member assembly for placement in a PVB valve.

Exemplary embodiments of the present disclosure provide a new and improved valve member assembly for removable placement in a chamber of a valve body, the chamber extending between an open end of the valve body and an inlet port of the valve body. The valve member assembly includes a housing containing a check valve assembly and a float valve assembly.

The housing has a cup, a retainer and a bonnet that are releasably secured together to contain the check valve assembly and the float valve assembly. The cup includes a cup base defining a check valve seat for the inlet port of the valve body, a cup rim spaced from the cup base, and cup arms connecting the cup base to the cup rim. The retainer has a retainer base positioned on the cup rim, a retainer rim spaced from the retainer base, and retainer arms connecting the retainer base to the retainer rim. The bonnet includes a bonnet base positioned on the retainer rim and defining a float valve seat for placement adjacent the open end of the valve body when the valve member assembly is placed in the chamber of the valve body. The housing also includes means for releasably securing the retainer to the cup, and means for releasably securing the bonnet to the retainer.

The check valve assembly is positioned within the cup of the housing and includes a check valve member, and a check spring biasing the check valve member away from the retainer and against the inlet valve seat. The float valve assembly is positioned between the bonnet and the retainer of the housing and includes a float valve member, and a float spring biasing the float valve member away from the float valve seat.

According to one aspect of the disclosure, the means for releasably securing the retainer base to the cup rim include the retainer base having radially extending projections alignable with radially extending projections of the cup rim. The means for releasably securing the bonnet base to the retainer rim includes the bonnet base having radially extending projections alignable with radially extending projections of the retainer rim.

According to a further aspect of the disclosure, the check valve member includes a shaft slidably extending through an opening in the retainer base. In addition, the float valve member includes a cylindrical guide extending towards the opening in the retainer base for receiving the shaft of the check valve member.

According to another aspect of the disclosure, the valve member assembly further includes a thermal expansion relief valve operatively positioned in the float valve member for allowing fluid to exit the chamber of the valve body through the open end of the valve body when fluid pressure within the chamber exceeds a predetermined value Additional aspects and advantages of the present disclosure will become readily apparent to those skilled in this art from the following detailed description, wherein only exemplary embodiments of the present disclosure are shown and described, simply by way of illustration of the best mode contemplated for carrying out the present disclosure. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

BRIEF DESCRIPTION OF DRAWINGS

Reference is made to the attached drawings, wherein elements having the same reference character designations represent like elements throughout.

DETAILED DESCRIPTION OF AN EXEMPLERY EMBODIMENT

Figure 1:
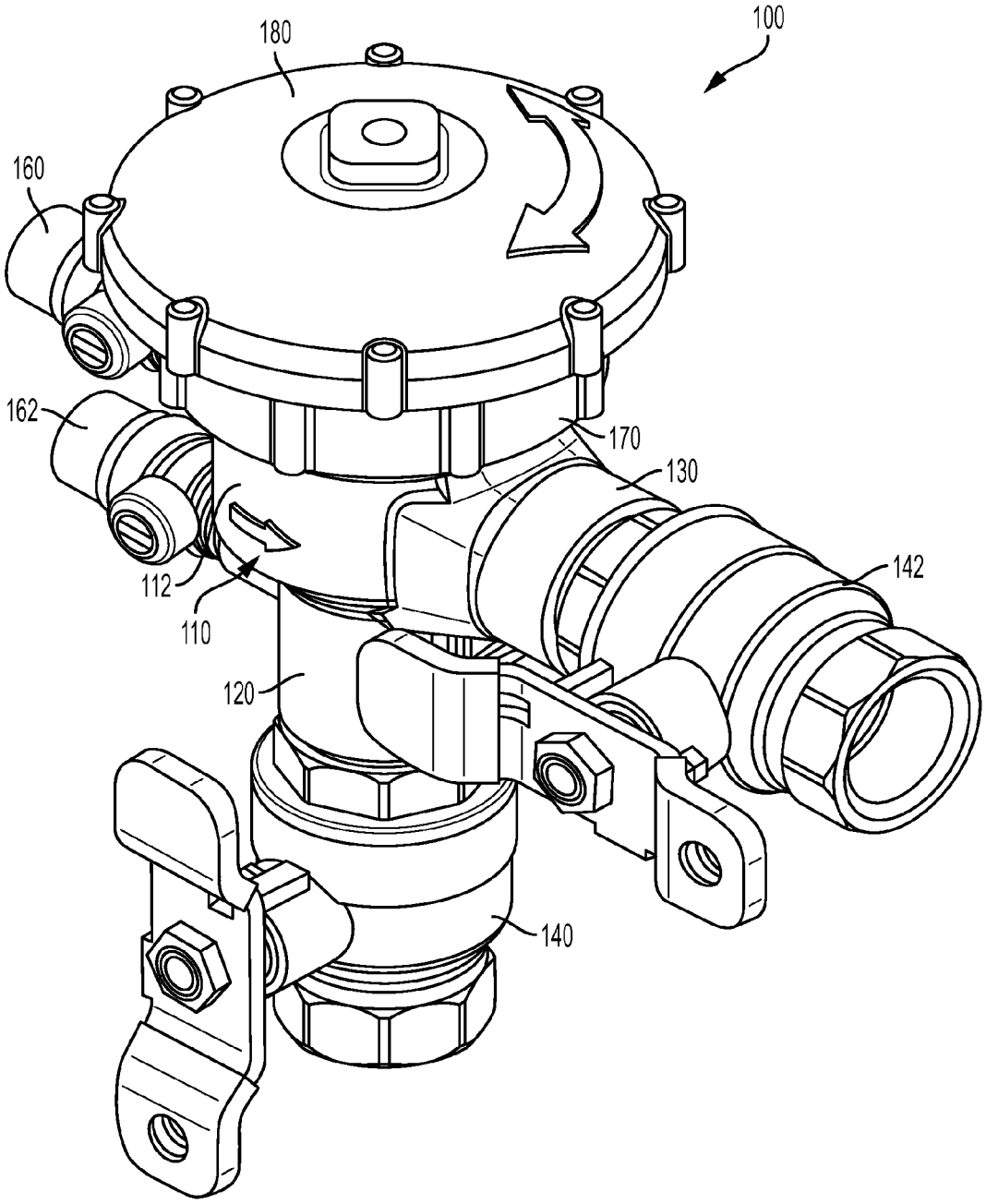
FIG. 1 is a side and top perspective view of an exemplary embodiment of a pressure vacuum breaker (PVB) valve constructed in accordance with the present disclosure.
Figure 2:
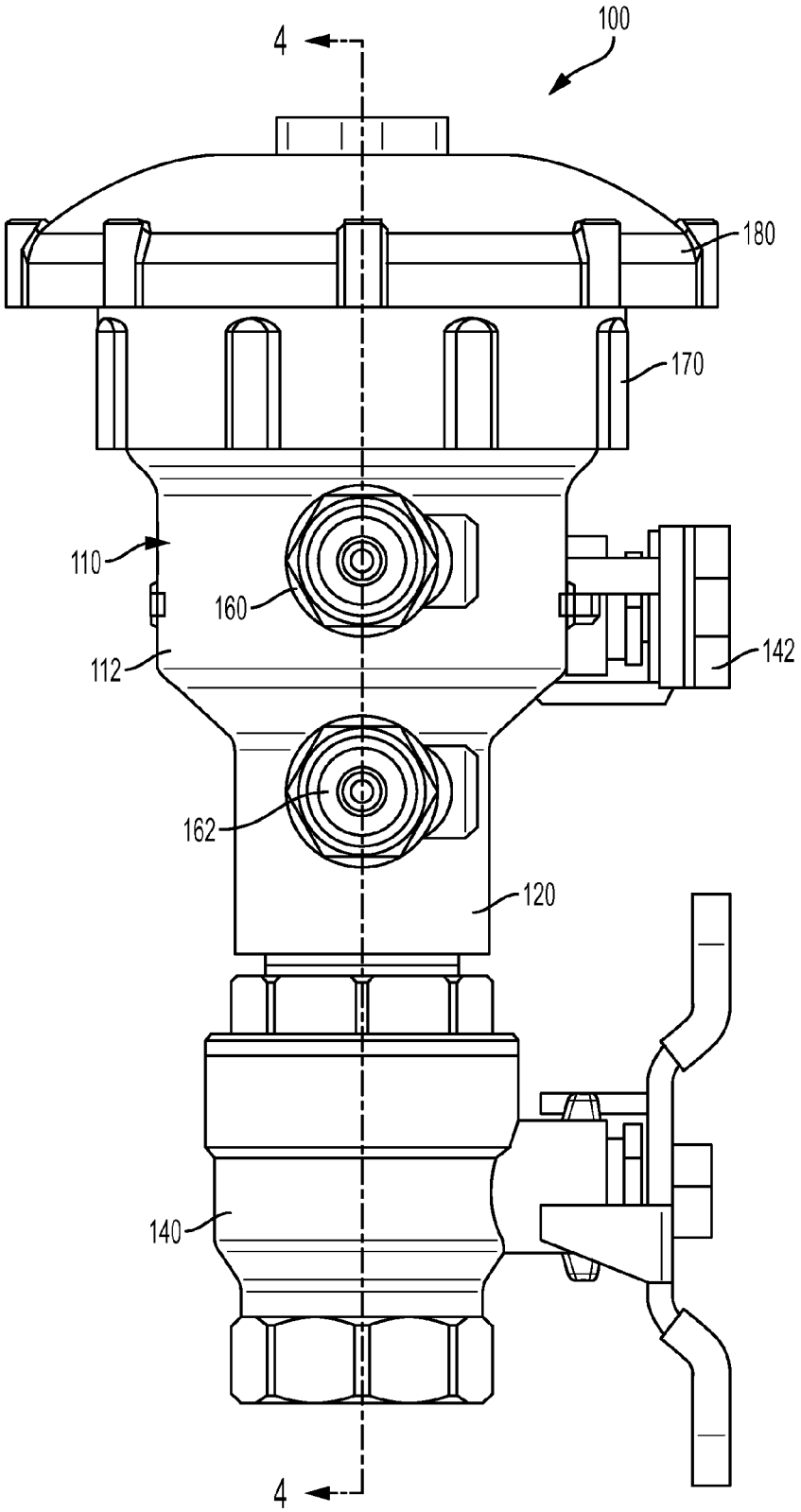
FIG. 2 is a side elevation view of the PVB valve of FIG. 1.

The present disclosure overcomes many of the prior art problems associated with back-siphonage in water systems having pressure vacuum breaker valves. The advantages, and other features of the technology disclosed herein, will become more readily apparent to those having ordinary skill in the art from the following detailed description of certain preferred embodiments taken in conjunction with the drawings which set forth representative embodiments of the present invention and wherein like reference numerals identify similar structural elements.

Referring now to the detailed drawings, FIGS. 1-4 show an exemplary embodiment of a pressure vacuum breaker (PVB) valve 100 that can be used, for example, to protect against back-siphonage conditions in industrial plants, laboratories, laundries, swimming pools and lawn sprinkler systems. The PVB valve 100 contains a modular and easily replaceable valve member assembly 10 that is constructed in accordance with the present disclosure. Exemplary embodiments of the valve member assembly 10, and parts thereof, are shown in FIGS. 5-24. The valve member assembly 10 may also be referred to as a valve member cartridge.

Referring still to FIGS. 1-4, the PVB valve 100 includes a body 110 having a central portion 112 with an open end 114 and a chamber 116 extending from the open end 114. The body 110 is made of a strong and rigid material, such as brass. The body could also be made of a suitable plastic, including a glass reinforced polypropylene, such as Noryl® resin reinforced with glass fibers. A tubular first branch 120 extends from the central portion 112, opposite the open end 114, and a tubular second branch 130 extends from the central portion 112 generally perpendicular to the first branch 120. The tubular first branch 120 forms an inlet port 122 in fluid communication with the chamber 116, and the tubular second branch 130 forms an outlet port 132 in fluid communication with the chamber 116. In the exemplary embodiment shown, flow control valves 140, 142 are connected to each of the inlet and outlet ports 122, 132, respectively, to control fluid flow into and out of the chamber 116. The flow control valves may comprise manual ball valves 140, 142, as shown.

The body 110 may also include a first auxiliary port 150 extending through the central portion 112 and in fluid communication with the chamber 116, and a second auxiliary port 152 extending through the first branch 120 and in fluid communication with the inlet port 122. In the exemplary embodiment shown, flow control valves 160, 162 are connected to each of the auxiliary ports 150, 152, respectively, to control fluid flow into and out of the chamber 116 and the inlet port. The flow control valves may comprise manual ball valves 160, 162, as shown. The auxiliary ports 150, 152 and valves 160, 162 can be used to test and drain the PVB valve 100.

Figure 3:
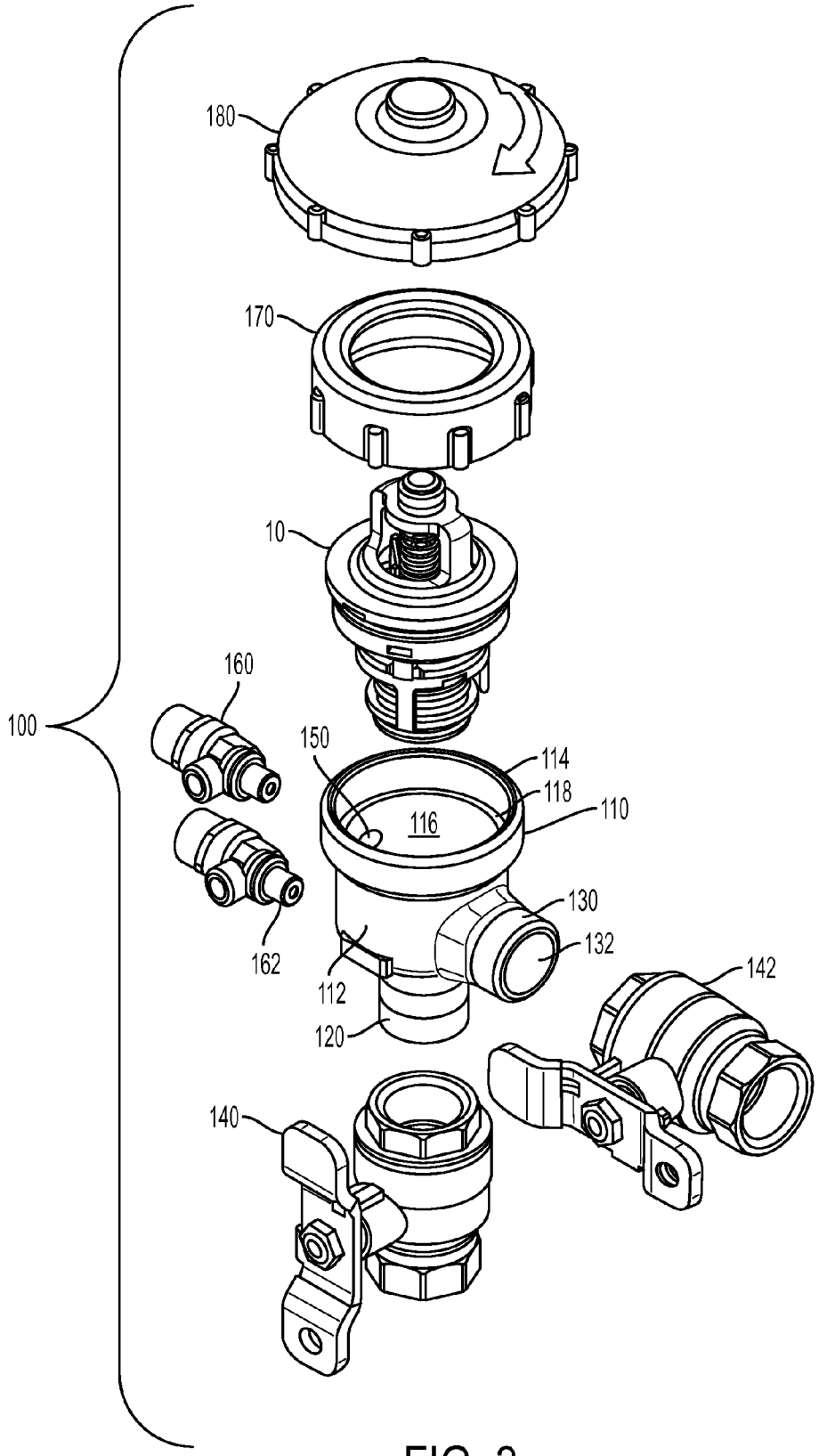
FIG. 3 is an exploded side and top perspective view of the PVB valve of FIG. 1, wherein a valve member assembly constructed in accordance with the present disclosure is shown.
Figure 4:
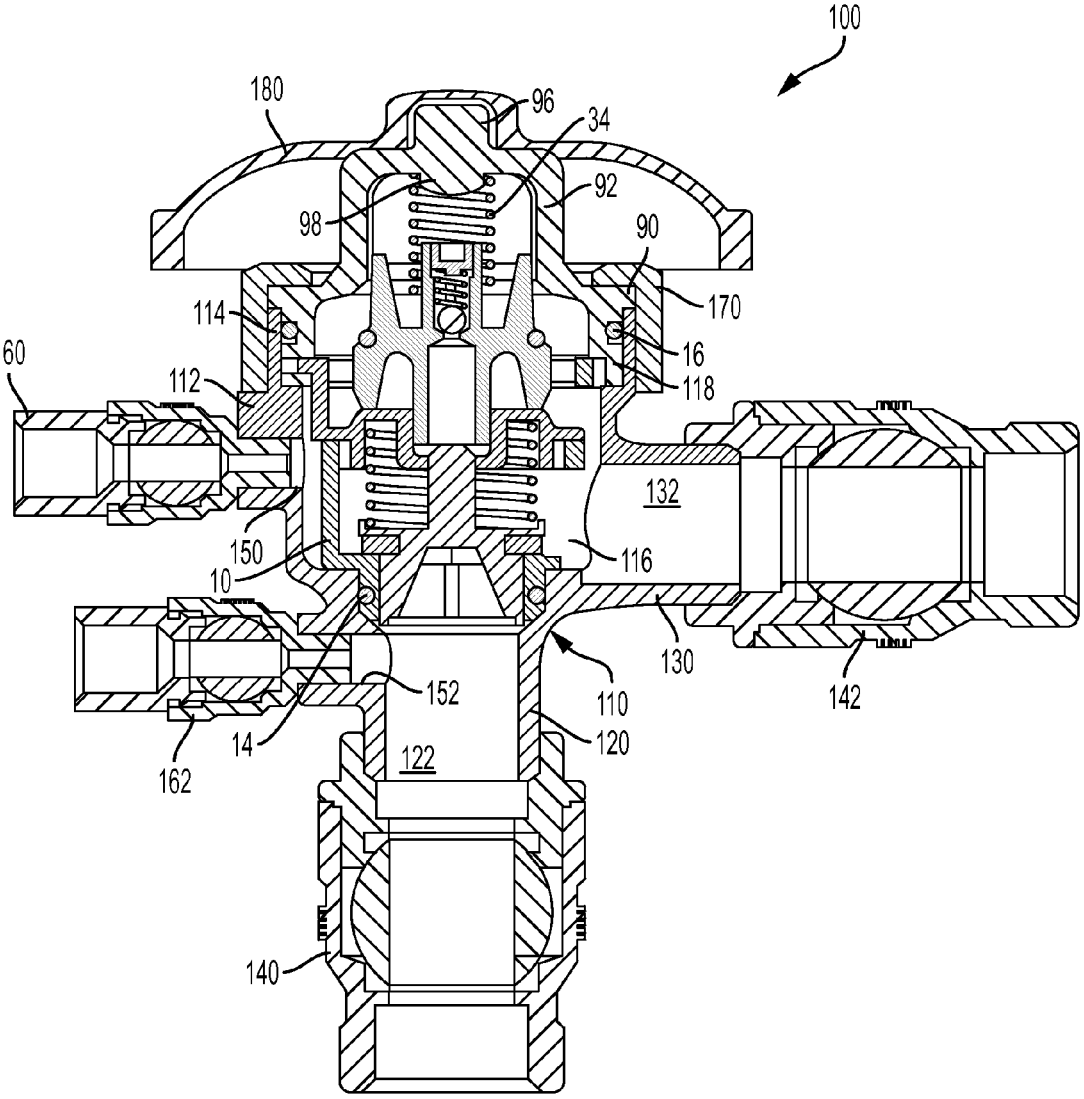
FIG. 4 is a sectional view of the PVB valve of FIG. 1 taken along line 4-4 of FIG. 2.
Figure 5:
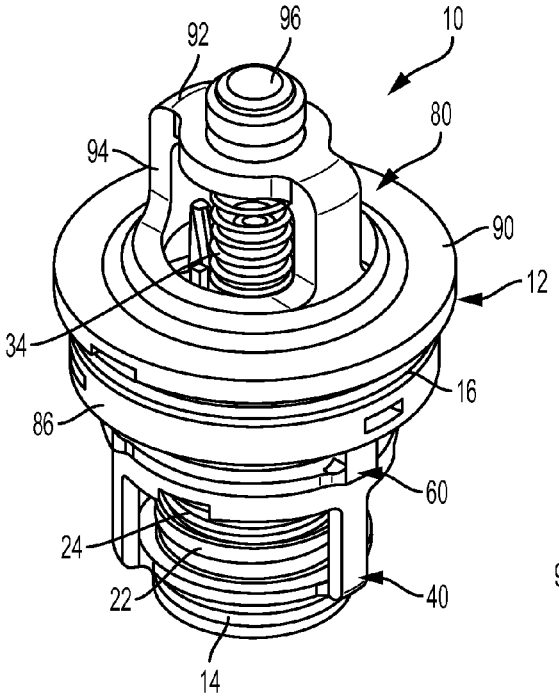
FIG. 5 is a side and top perspective view of the valve member assembly of the PVB valve of FIG. 1.
Figure 6:
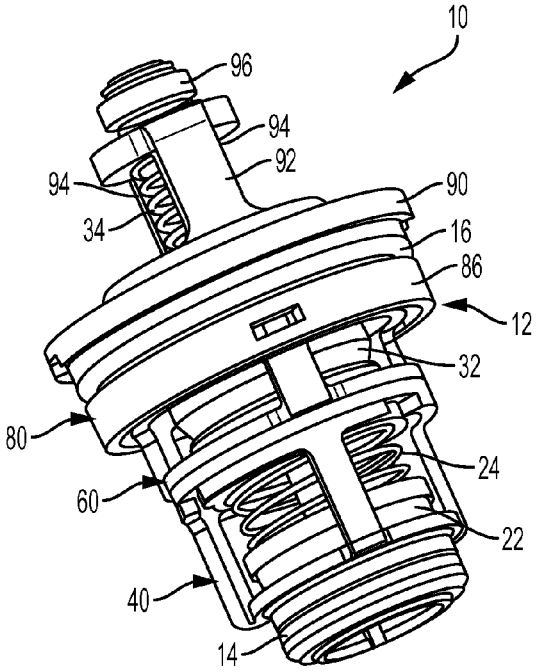
FIG. 6 is a side and bottom perspective view of the valve member assembly of the PVB valve of FIG. 1.
Figure 7:
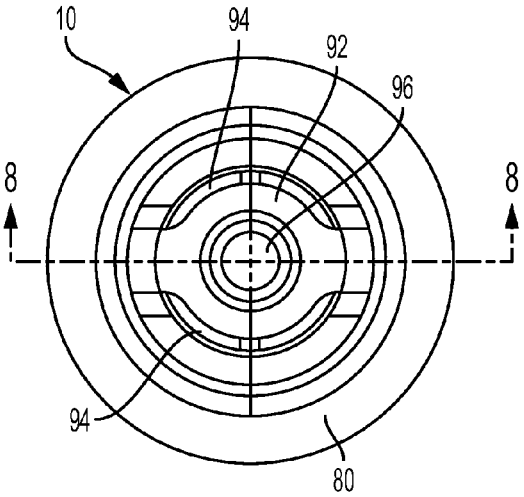
FIG. 7 is a top plan view of the valve member assembly of the PVB valve of FIG. 1.
Figure 8:
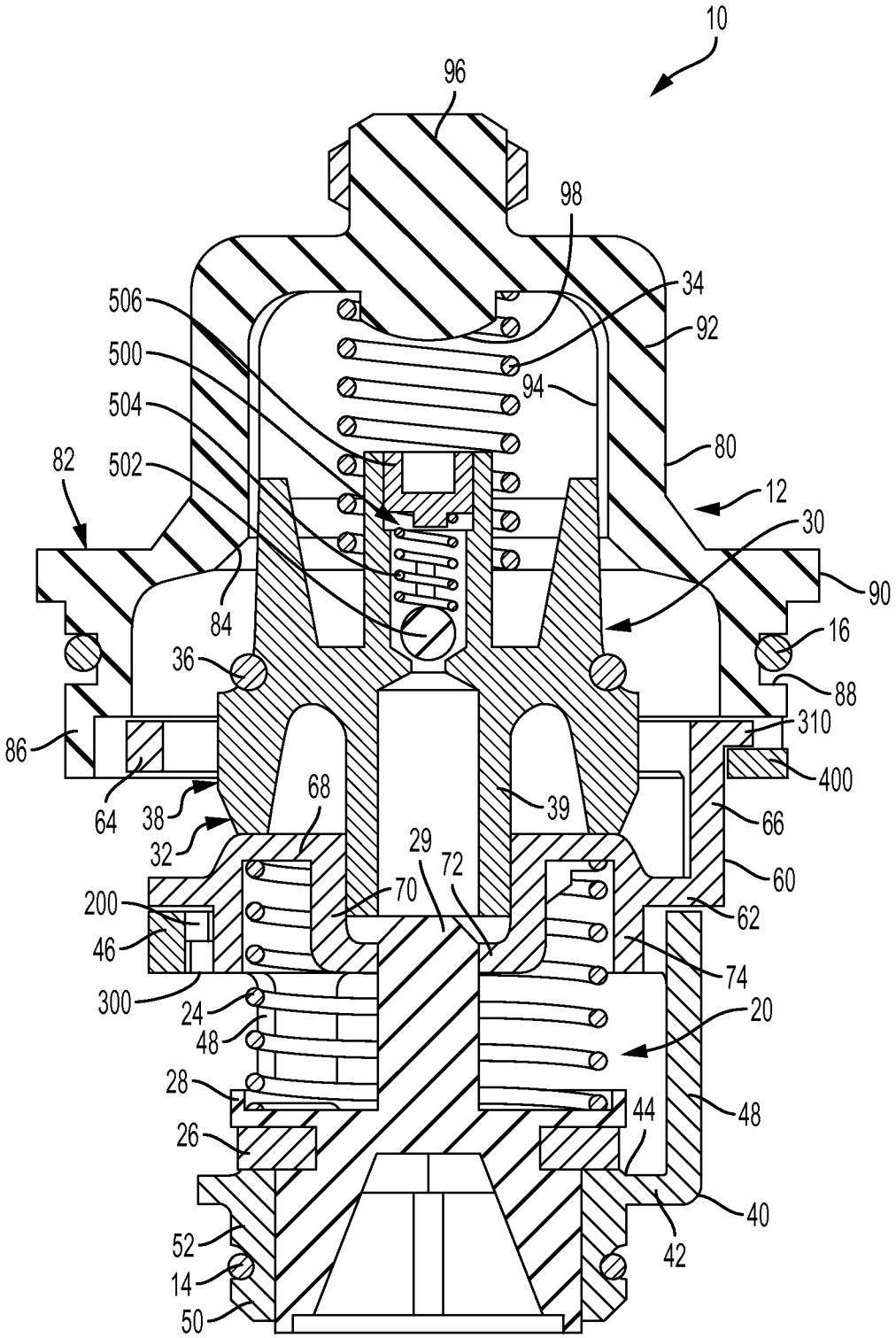
FIG. 8 is a sectional view of the valve member assembly taken along line 8-8 of FIG. 7.
Figure 9:
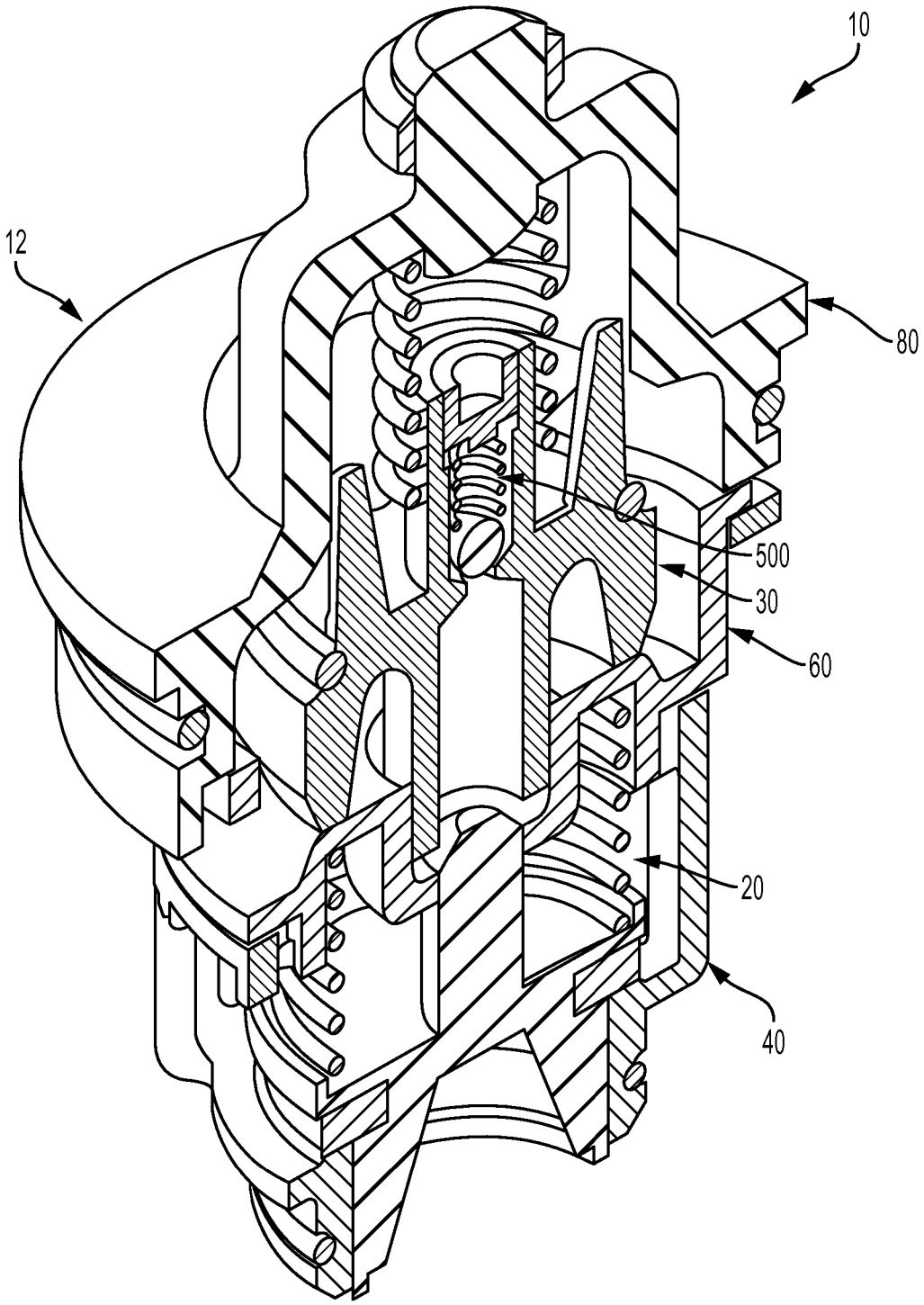
FIG. 9 is a side and top perspective view, in section, of the valve member assembly taken along line 8-8 of FIG. 7.
Figure 10:
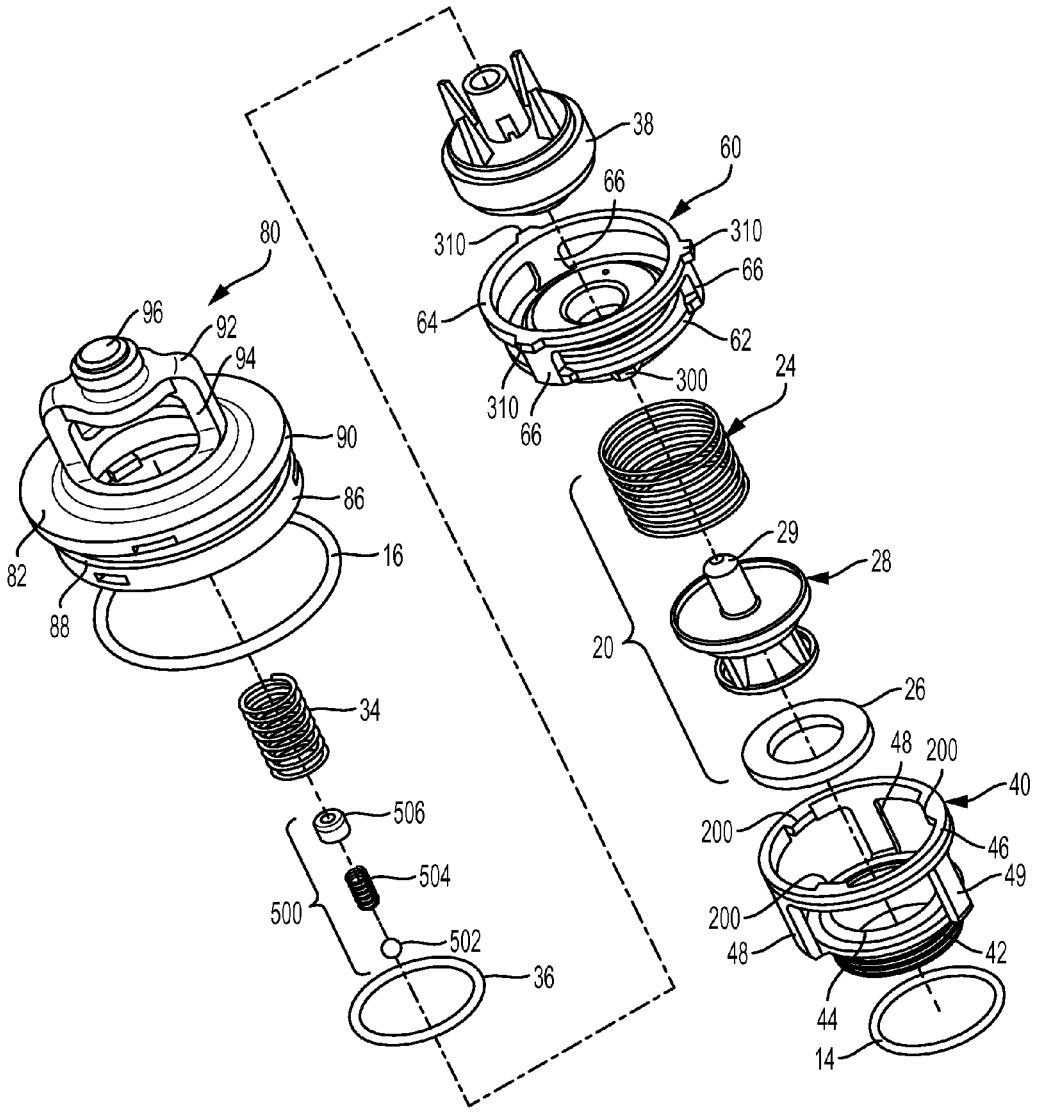
FIG. 10 is an exploded side and top perspective view of the valve member assembly of the PVB valve of FIG. 1, wherein a bonnet, retainer and cup constructed in accordance with the present disclosure are shown.
Figure 11:
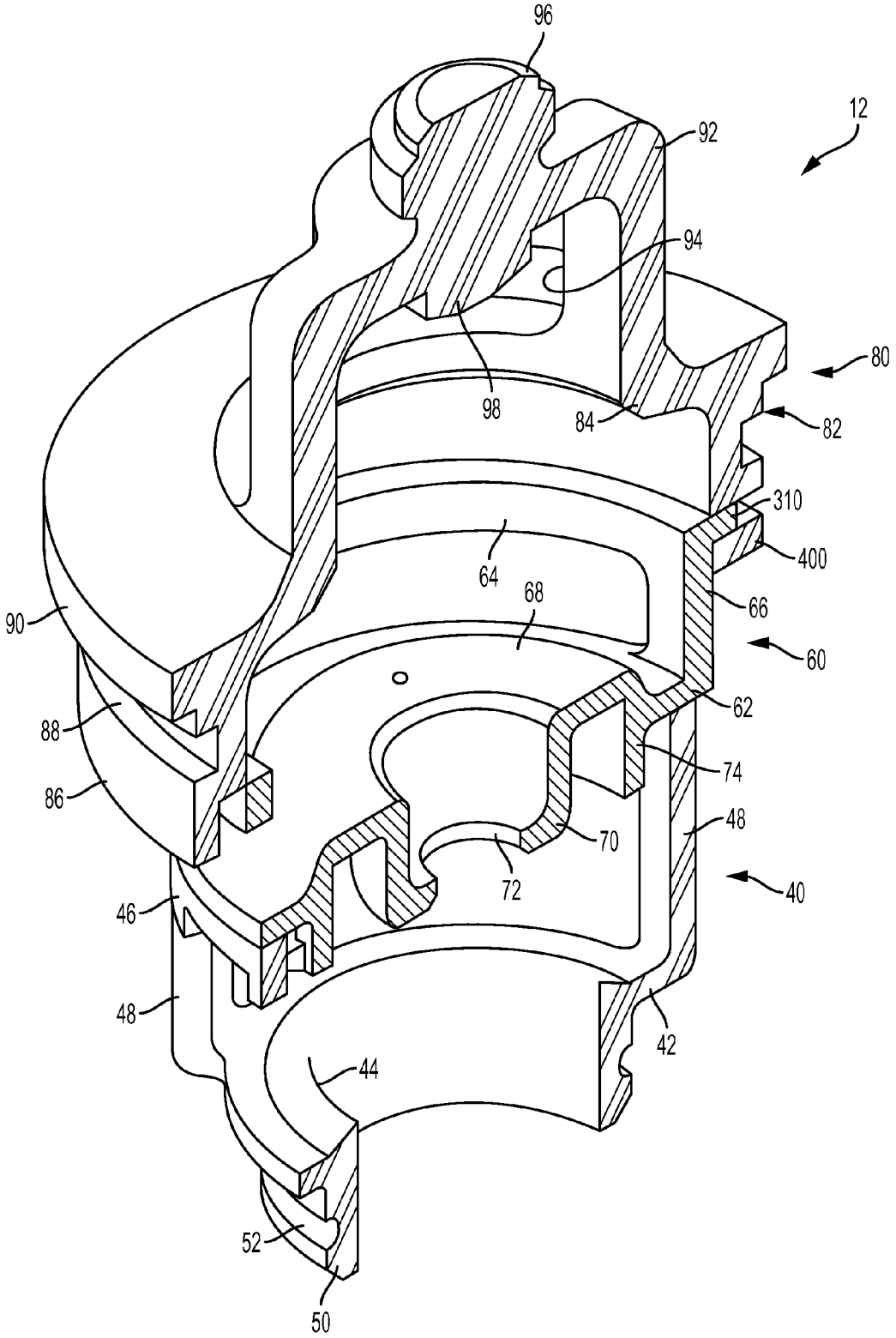
FIG. 11 is a side and top perspective view, in section, of a housing of the valve member assembly.
Figure 12:
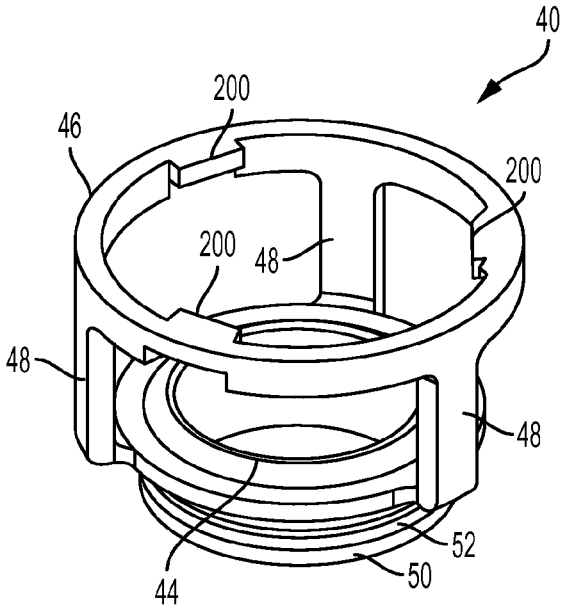
FIG. 12 is a side and top perspective view of the cup.
Figure 13:
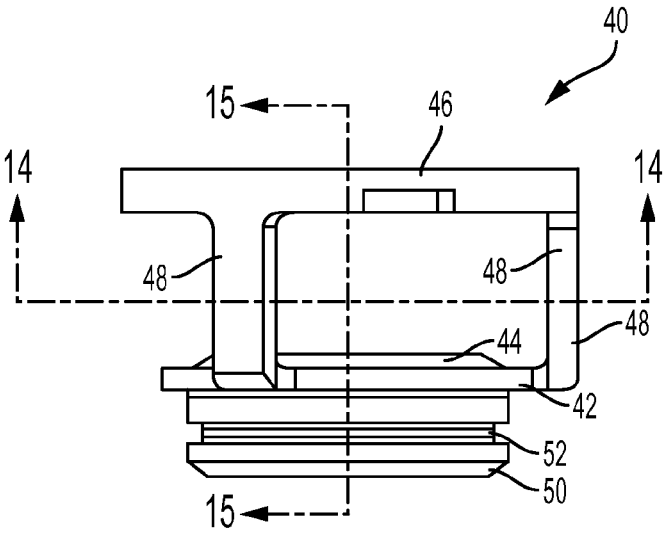
FIG. 13 is a side elevation view of the cup.

As shown in FIGS. 3 and 4, the valve member assembly 10 is received within the chamber 116 of the body 110 and extends out of the open end 114. The PVB valve 100 includes a collar 170 removably attached to the valve body 110 over the open end 114 and securing the valve member assembly 10 in the chamber 116 of the valve body 110. In the exemplary embodiment shown, the collar 170 is removable attached to the valve body 110 with screw threads, although other means of removable attached could be used. The collar 170 is made of a strong and rigid material. In the exemplary embodiment shown, the collar 170 is made of Noryl® resin reinforced with glass fibers.

Referring to FIGS. 5 through 11, the valve member assembly 10 includes a housing 12 containing a check valve assembly 20 and a float valve assembly 30. The housing 12 has a cup 40, a retainer 60 and a bonnet 80 that are releasably secured together to contain the check valve assembly 20 and the float valve assembly 30. The housing 12 is made of a strong and relatively rigid material, such as a suitable metal, such as stainless steel or brass, or reinforced plastic. In the exemplary embodiment shown, the housing 12 is made of Noryl® resin reinforced with glass fibers.

Referring to FIGS. 12-15, the cup 40 includes a cup base 42 defining a check valve seat 44 for the inlet port 122 of the valve body 110, a cup rim 46 spaced from the cup base 42, and cup arms 48 connecting the cup base 42 to the cup rim 46. As shown best in FIG. 4, the cup base 42 of the exemplary embodiment includes a cylindrical distal portion 50 that extends into the inlet port 122 of the valve body 110 when the assembly 10 is fully inserted into the chamber 116 of the valve body 110. An O-ring 14 is positioned in a groove 52 on an outer surface of the distal portion 50 to provide a fluid-tight seal between the distal portion 50 and the valve body 110.

Referring to FIGS. 8, 9, 11 and 16-19, the retainer 60 has a retainer base 62 positioned on the cup rim 46, a retainer rim 64 spaced from the retainer base 62, and retainer arms 66 connecting the retainer base 62 to the retainer rim 64. In the exemplary embodiment shown, the retainer base 62 includes a raised annular portion 68 extending to a bowl 70, and an opening 72 formed in the bowl 70. The retainer base 62 also includes a cylindrical wall 74 extending downward from a bottom surface, and ribs 76 extending from the bowl 70 towards the wall 74.

Referring to FIGS. 20-24, the bonnet 80 includes a bonnet base 82 positioned on the retainer rim 64 and defining a float valve seat 84 for placement adjacent the open end 114 of the valve body 110 when the valve member assembly 10 is placed in the chamber 116 of the valve body 110. The bonnet base 82 also includes a distal portion received in the open end of the valve body 110 on an internal shoulder 118 of the valve body 110. An O-ring 16 is positioned in a groove 88 on an outer surface of the distal portion 86 to provide a fluid-tight seal between the distal portion 88 and the valve body 110. The bonnet base 82 also includes a radially extending rim 90 above the distal portion 86 that is secured between the body 110 and the collar 170.

In the exemplary embodiment shown, the bonnet 80 further includes a dome 92 extending from the bonnet base 82 for extending out of the open end 114 of the valve body 110 when the valve member assembly 10 is placed in the chamber 116 of the valve body 110. The dome 92 includes at least one vent 94 that allows air to enter the chamber 116 through the float valve seat 84, or water to exit the chamber 116 through the float valve seat 84.

The bonnet 80 also includes an upwardly extending boss 96 extending from the dome 92. A canopy 180 of the valve 100 is removably secured to the boss 96. In the exemplary embodiment shown, the canopy 180 is secured to the boss 96 with screw threads, although other means of removable securement could be used. The bonnet 80 also includes a downward extending boss 98 extending from the dome 92. The canopy 180 is made of a strong and rigid material, such as Noryl® resin reinforced with glass fibers.

The housing 12 further includes means for releasably securing the retainer 60 to the cup 40, and means for releasably securing the bonnet 80 to the retainer 60. In the exemplary embodiment shown, the means for releasably securing the retainer 60 to the cup 40 includes the wall 74 of the retainer base 62 having radially extending projections 300 (best seen in FIGS. 16-18) alignable with radially extending projections 200 (best seen in FIGS. 21, 21*a*, 23, and 24) of the cup rim 46. The means for releasably securing the bonnet base 82 to the retainer rim 64 includes distal portion 86 of the bonnet base 82 having radially extending projections 400 (best seen in FIGS. 14 and 14*a*) alignable with radially extending projections 310 of the retainer rim 64.

It should be understood, however, that structures or features other than radially extending projections could be substituted for the means for releasably securing the retainer 60 to the cup 40 and the means for releasably securing the bonnet 80 to the retainer 62. Such means, for example, could include screw threads, snap fittings or bayonet connections.

In addition, the present disclosure covers embodiments of the housing wherein the cup, the retainer and the bonnet are permanently connected together with the valve assemblies 20, 30 contained therein. Furthermore, the present disclosure covers embodiments of the housing wherein the housing is divided vertically into two or more side-by-side parts instead of being divided horizontally into three parts: the cup, the retainer and the bonnet. In such a "side-by-side: embodiment, the side-by-side parts would be secured together, either permanently or releasably, with the valve assemblies 20, 30 there between. In vertically divided versions, the housing is preferably snap-fit together.

Referring back to FIGS. 8-9, and 11-19, in the exemplary embodiment shown, the radially extending projections 200 of the cup rim 46 extend inward and the radially extending projections 300 of the retainer base 62 extend outward. The cylindrical wall 74 of the retainer base 62 extends into the cup rim 46, and the projections 300 extend from the wall 74 such that the projections 300 are located lower, and underneath, the projections 200 of the cup rim 46. The retainer 60 can be rotated clockwise or counter-clockwise with respect to the cup 40 to align the projections 300 of the retainer base 62 and the projections 200 of the cup rim 46, and secure the retainer 60 to the cup 40.

Figure 14:
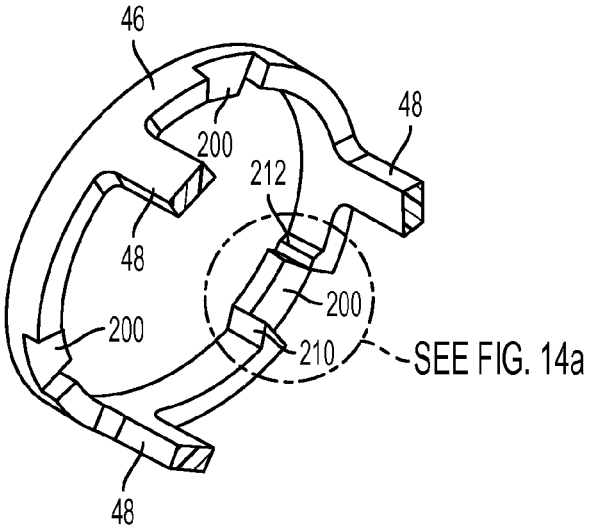
FIG. 14 is a sectional view, in perspective, of the cup taken along line 14-14 of FIG. 13.
Figure 14A:
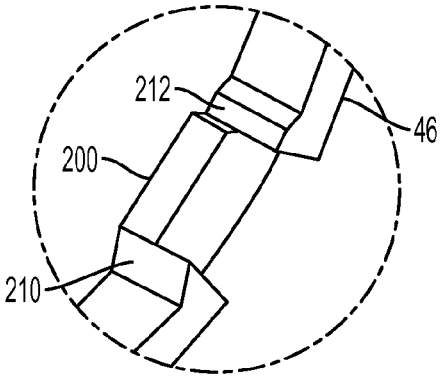
FIG. 14*a* is an enlarged view, in perspective, of the circled portion of the cup in FIG. 14.
Figure 15:
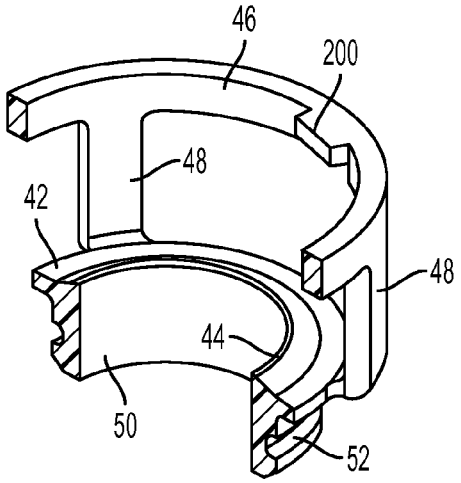
FIG. 15 is a sectional view, in perspective, of the cup taken along line 15-15 of FIG. 13.
Figure 16:
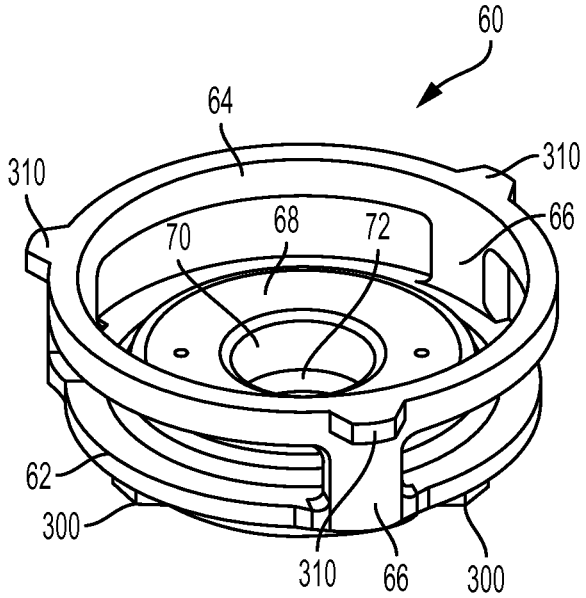
FIG. 16 is a side and top perspective view of the retainer.
Figure 17:
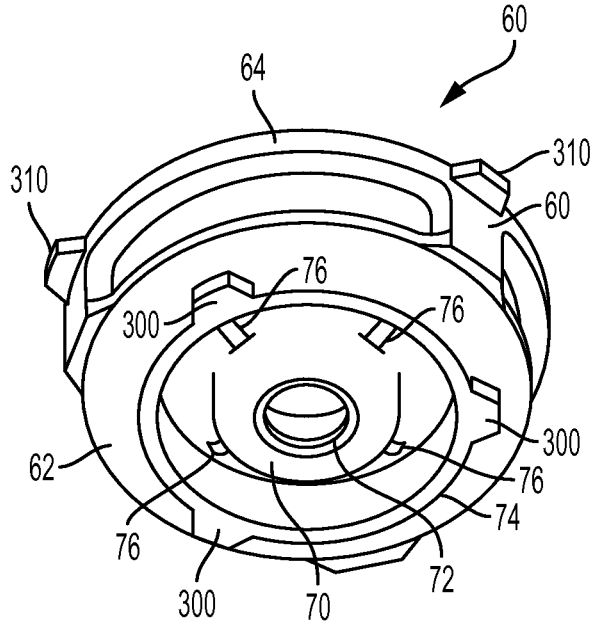
FIG. 17 is a side and bottom perspective view of the retainer.
Figure 18:
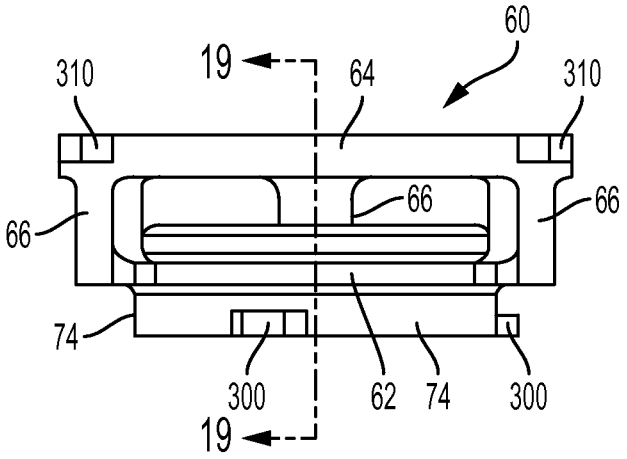
FIG. 18 is a side elevation view of the retainer.
Figure 19:
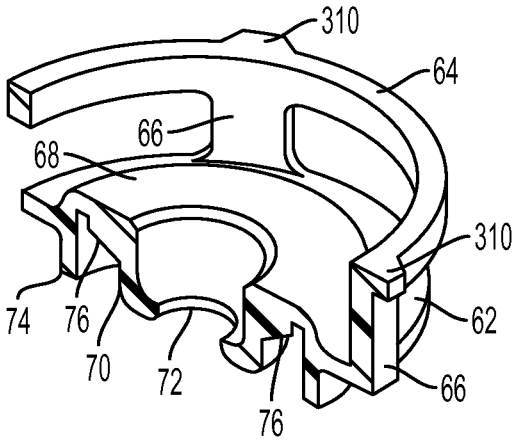
FIG. 19 is a sectional view, in perspective, of the retainer taken along line 19-19 of FIG. 18.
Figure 20:
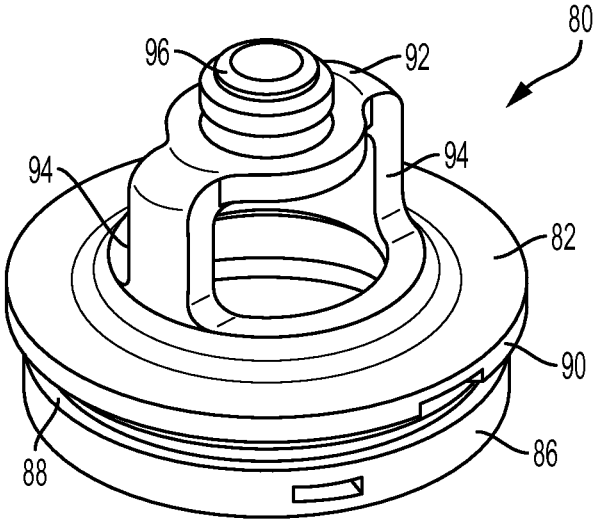
FIG. 20 is a side and top perspective view of the bonnet.

As shown best in FIGS. 14 and 14*a*, the cup rim 46 further includes opposing ramps 210, 212 on opposite sides of at least one projection 200. The ramps 210, 212 are for capturing one of the projections 300 of the retainer base 62 when the projections 300 of the retainer base 62 are aligned with the projections 200 of the cup rim 46. The ramps 210, 212 of the cup rim 46 prevent further rotation of the retainer 60, and help secure the retainer to the cup, unless a greater rotational force is applied to the retainer 60 to force the projection 300 from between the ramps 210, 212. In the exemplary embodiment shown, one of the ramps 212 is truncated; such the retainer 60 can be rotated in one direction more easily to release the captured projection 300 over the truncated ramp 212.

Referring to FIGS. 8-9, 11 and 16-24, in the exemplary embodiment shown, the radially extending projections 400 of the bonnet base 82 extend inward and the radially extending projections 310 of the retainer rim 64 extend outward. The distal portion 86 of the bonnet base 82 extends into the retainer rim 64, and the projections 400 extend from the distal portion 86 such that the projections 400 are located lower, and underneath, the projections 310 of the retainer rim 64. The bonnet 80 can be rotated with respect to the retainer 60 to align the projections 400 of the bonnet base 62 and the projections 200 of the cup rim 46, and secure the retainer 60 to the cup 40.

Figure 21:
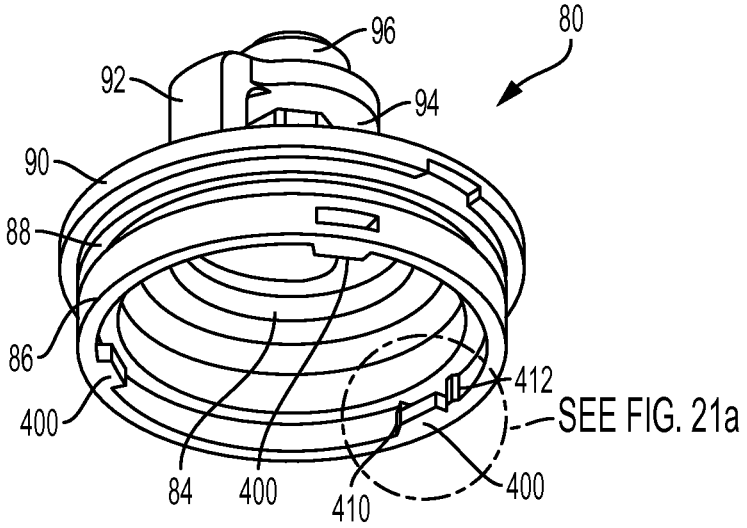
FIG. 21 is a side and bottom perspective view of the bonnet.
Figure 21A:
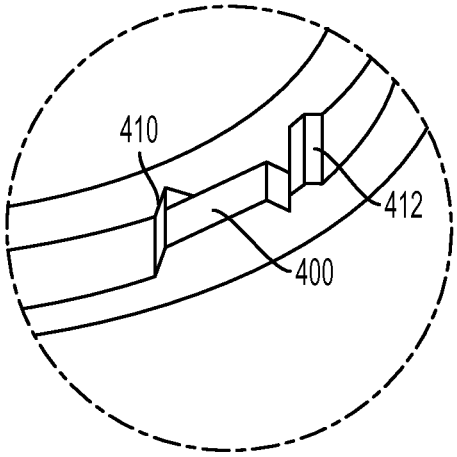
FIG. 21*a* is an enlarged view, in perspective, of the circled portion of the bonnet in FIG. 21.
Figure 22:
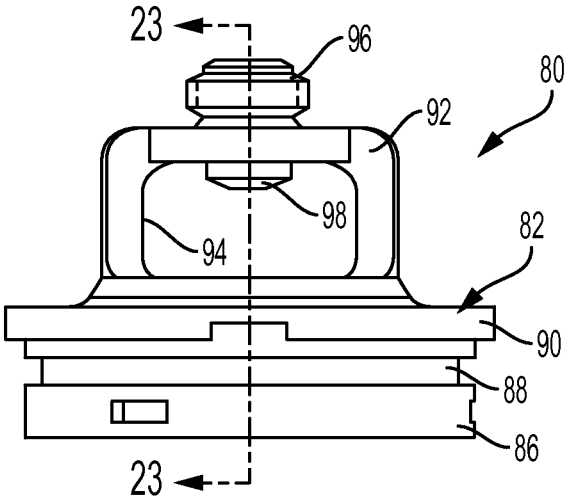
FIG. 22 is a side elevation view of the bonnet.
Figure 23:
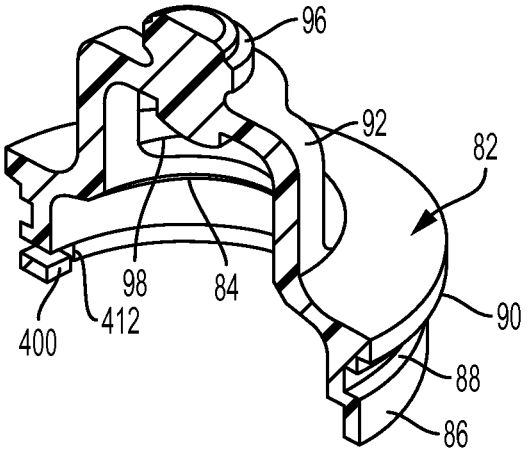
FIG. 23 is a sectional side and top perspective of the bonnet taken along line 23-23 of FIG. 22.
Figure 24:
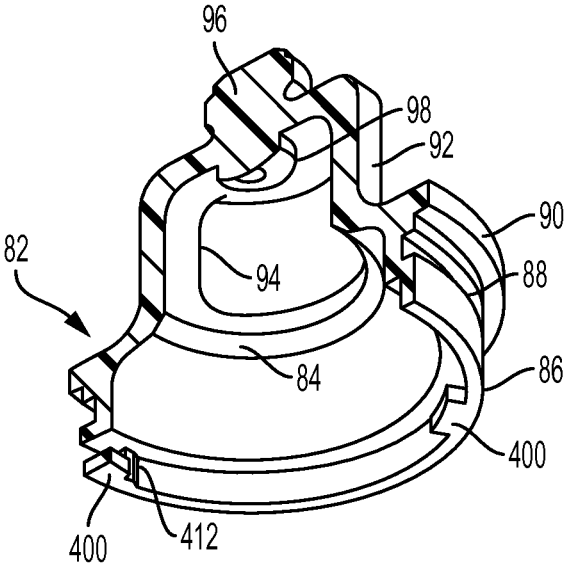
FIG. 24 is a sectional side and bottom perspective of the bonnet taken along line 24-24 of FIG. 22.

As shown best in FIGS. 21 and 21*a*, the bonnet base 82 further includes opposing ramps 410, 412 on opposite sides of at least one projection 400. The ramps 410, 412 are for capturing one of the projections 310 of the retainer rim 64 when the projections 310 of the retainer rim 64 are aligned with the projections 400 of the bonnet base 82. The ramps 410, 412 prevent further rotation of the bonnet 80 with respect to the retainer 60, and help secure the bonnet 80 to retainer 60, unless a greater rotational force is applied to the bonnet 80 to force the projection 310 from between the ramps 410, 412. In the exemplary embodiment shown, one of the ramps 412 is truncated; as such the bonnet 80 can be rotated in one direction more easily to release the captured projection 310 over the truncated ramp 412.

Referring again to FIGS. 8-10, the check valve assembly 20 is positioned within the cup 40 of the housing 12 and includes a check valve member 22, and a check spring 24 biasing the check valve member 22 away from the retainer 60 and against the check valve seat 44. When the check valve member 22 is in an open position pushed away from the check valve seat 44, the check valve assembly 20 allows fluid flow from the inlet port 122 to the chamber 116. Fluid in the chamber 116 then exits the chamber through the outlet port 132. When the check valve member 22 is in a closed position biased against the check valve seat 44, the check valve assembly 20 prevents reversed fluid flow from the chamber 116 into the inlet port 122. In other words, the check valve assembly 20 prevents backflow, and can be used to prevent the backflow of water into a potable water supply connected to the inlet port 122.

In the exemplary embodiment shown, the check spring 24 is a compression spring positioned between the retainer base 62 and the check valve member 22. An end of the check spring 24 is received between the wall 74 and the ribs 76 of the retainer 60. The check valve member 22 includes a resilient disk seal 26 and a disk holder 28. The disk holder 28 includes a shaft 29 slidably extending through the opening 72 in the retainer base 62.

The float valve assembly 30 is positioned between the bonnet 80 and the retainer 60 of the housing 12 and includes a float valve member 32, and a float spring 34 biasing the float valve member 32 away from the float valve seat 84. When the float valve member 32 is in an open position biased away from the float valve seat 84, the float valve assembly 30 allows fluid to exit the chamber 116 through the float valve seat 84, and then through the vents 94 of the bonnet 90, and air to enter the chamber 116 through the vents 94 of the bonnet 90 and the float valve seat 84. Allowing air into the chamber 116 prevents a back siphon condition. The float valve member 32, for example, may move to an open position when pressure within the chamber 116 falls below 1.5 psi for a ½" to 2" PVB valve. When the float valve member 32 is in a closed position pushed against the float valve seat 84, the float valve assembly 30 prevents air and fluid from passing through the float valve seat 84.

In the exemplary embodiment shown, the float spring 34 is a compression spring positioned between the dome 92 of the bonnet 80 and the float valve member 32. An end of the float spring 34 is received on the boss 98 of the bonnet 80. The float valve member includes a resilient O-ring seal 36, for forming a fluid tight seal against the float valve seat 84, and an O-ring holder 38. The O-ring holder 38 includes a hollow cylindrical guide 39 extending towards the retainer base 62. An open end of the hollow cylindrical guide 39 is received within the bowl 70 of the retainer base 62, above the opening 72, and the hollow cylindrical guide 39 is sized to receive the full length of the shaft 29 of the check valve member 22, when the check valve member 22 is in a fully opened position.

The valve member assembly 10 can also include a thermal expansion relief valve 500 operatively positioned in the float valve member 32 for allowing fluid to exit the chamber 116 of the valve body 110 when fluid pressure within the chamber exceeds a predetermined value. The predetermined value may, for example, be 150 psi for a ½" to 2" PVB valve. In the exemplary embodiment shown, thermal expansion relief valve 500 includes a ball 502, a spring 504 and a plug 506.

The present disclosure, therefore, provides a new and improved valve. It should be understood, however, that the exemplary embodiment described in this specification has been presented by way of illustration rather than limitation, and various modifications, combinations and substitutions may be effected by those skilled in the art without departure either in spirit or scope from this disclosure in its broader aspects and as set forth in the appended claims. Accordingly, other embodiments are within the scope of the following claims. In addition, the valve disclosed herein, and all elements thereof, are contained within the scope of at least one of the following claims. No elements of the presently disclosed valve are meant to be disclaimed.

What is claimed is:

1. A valve member assembly for placement in a chamber of a valve body, the chamber extending between a bottom end defining an inlet port and an open top end of the valve body, the valve member assembly comprising:

a) a housing having, i. a cup including a cup base defining a check valve seat for the inlet port of the valve body, and cup arms extending upwardly from the cup base, ii. a retainer including a retainer base positioned above the cup base and connected to the cup arms, and retainer arms extending upwardly from the retainer base, and iii. a bonnet including, a bonnet base positioned above the retainer base and connected to the retainer arms, the bonnet base defining a float valve seat, and a dome extending from the bonnet base for extending out of the open top end of the valve body when the valve member assembly is placed in the chamber of the valve body, the dome defining at least one vent;

b) a check valve assembly including, i. a check valve member positioned between the cup base and the retainer base and including a shaft slidably extending through an opening in the retainer base, and ii. a check spring positioned between the retainer base and the check valve member, biasing the check valve member against the inlet valve seat, and c) a float valve assembly including, i. a float valve member positioned between the bonnet base and the retainer base, and ii. a float spring positioned between the dome of the bonnet and the float valve member, biasing the float valve member away from the float valve seat, wherein the retainer further includes a spring socket extending downwardly from the retainer base and the check spring is received in the spring socket.

2. A valve including the valve member assembly of claim 1, and further comprising:

a) a valve body including, an open top end, a bottom end defining an inlet port, a chamber extending from the open top end to the bottom end and connected to the inlet port, an outlet port connected to the chamber through a sidewall of the body;

b) the valve member assembly removably positioned within the chamber of the valve body such that the check valve seat is placed over the inlet port of the valve body and the dome of the bonnet extends out of the open top end of the valve body;

c) a collar removable attached to the open top end of the valve body above the bonnet base to secure the valve member assembly in the chamber of the valve body; and d) a canopy removable attached to the dome of the bonnet.

3. A valve member assembly according to claim 2, further comprising a thermal expansion relief valve operatively positioned in the float valve member for allowing fluid to exit the chamber of the valve body through the open top end of the valve body when fluid pressure within the chamber exceeds a predetermined value.

4. A valve member assembly according to claim 1, wherein the retainer base is releasably connected to the cup arms and the bonnet base is releasably connected to the retainer arms.

5. A valve member assembly according to claim 1, further comprising means for connecting the retainer base to the cup arms and means for connecting the bonnet base to the retainer arms.

6. A valve member assembly according to claim 1, wherein the float valve member includes a cylindrical guide extending downward towards the opening in the retainer base for receiving the shaft of the check valve member extending through the opening of the retainer base.

7. A valve member assembly according to claim 1, wherein the retainer further includes a bowl formed in a top surface of the retainer base for receiving the cylindrical guide of the float valve member, and wherein the opening for the shaft of the check valve member is aligned with the bowl.

8. A valve member assembly comprising:

a) a housing having, i. a cup including, a cup base defining a check valve seat,
a cup rim spaced from the cup base, and
cup arms connecting the cup base to the cup rim,
ii. a retainer having,
a retainer base positioned on the cup rim,
a retainer rim spaced from the retainer base, and
retainer arms connecting the retainer base to the retainer rim,
the retainer base having radially extending projections alignable with radially extending projections of the cup rim to releasably secure the retainer to the base, and
iii. a bonnet including a bonnet base positioned on the retainer rim and defining a float valve seat, the bonnet base having radially extending projections alignable with radially extending projections of the retainer rim to releasably secure the bonnet to the retainer;
b) a check valve assembly positioned within the cup of the housing and including,
i. a check valve member including a shaft slidably extending through an opening in the retainer base, and
ii. a check spring biasing the check valve member away from the retainer and against the inlet valve seat; and
c) a float valve assembly positioned between the bonnet and the retainer of the housing and including,
i. a float valve member, and
ii. a float spring biasing the float valve member away from the float valve seat.

9. A valve member assembly according to claim 8, further comprising a thermal expansion relief valve operatively positioned in the float valve member.

10. A valve member assembly according to claim 8, wherein:
the radially extending projections of the cup rim extend inward and the radially extending projections of the retainer base extend outward, a portion of the retainer base extends into the cup rim, and the retainer can be rotated with respect to the cup to align the projections of the retainer base and the projections of the cup rim and releasably secure the retainer to the cup; and
the radially extending projections of the retainer rim extend outward and the radially extending projections of the bonnet base extend inward, the retainer rim is received in the bonnet base, and the bonnet can be rotated with respect to the retainer to align the projections of the bonnet base and the projections of the retainer rim and releasably secure the bonnet to the retainer.

11. A valve member assembly for placement in a chamber of a valve body, the chamber extending between a bottom end defining an inlet port and an open top end of the valve body, the valve member assembly comprising:
a) a housing having,
i. a cup including a cup base defining a check valve seat for the inlet port of the valve body, and cup arms extending upwardly from the cup base,
ii. a retainer including a retainer base positioned above the cup base and connected to the cup arms, and retainer arms extending upwardly from the retainer base, and
iii. a bonnet including,
a bonnet base positioned above the retainer base and connected to the retainer arms, the bonnet base defining a float valve seat, and
a dome extending from the bonnet base for extending out of the open top end of the valve body when the valve member assembly is placed in the chamber of the valve body, the dome defining at least one vent;
b) a check valve assembly including,
i. a check valve member positioned between the cup base and the retainer base and including a shaft slidably extending through an opening in the retainer base, and
ii. a check spring positioned between the retainer base and the check valve member, biasing the check valve member against the inlet valve seat;
c) a float valve assembly including,
i. a float valve member positioned between the bonnet base and the retainer base, and
ii. a float spring positioned between the dome of the bonnet and the float valve member, biasing the float valve member away from the float valve seat;
d) a valve body including,
i) an open top end,
ii) a bottom end defining an inlet port,
iii) a chamber extending from the open top end to the bottom end and connected to the inlet port, and
iv) an outlet port connected to the chamber through a sidewall of the body;
e) the valve member assembly removably positioned within the chamber of the valve body such that the check valve seat is placed over the inlet port of the valve body and the dome of the bonnet extends out of the open top end of the valve body;
f) a collar removable attached to the open top end of the valve body above the bonnet base to secure the valve member assembly in the chamber of the valve body; and
g) a canopy removable attached to the dome of the bonnet.

12. A valve member assembly according to claim 11, wherein the retainer base is releasably connected to the cup arms and the bonnet base is releasably connected to the retainer arms.

13. A valve member assembly according to claim 11, further comprising means for connecting the retainer base to the cup arms and means for connecting the bonnet base to the retainer arms.

14. A valve member assembly according to claim 11, wherein the retainer further includes a spring socket extending downwardly from the retainer base and the check spring is received in the spring socket, wherein the retainer further includes a bowl formed in a top surface of the retainer base for receiving the cylindrical guide of the float valve member, and wherein the opening for the shaft of the check valve member is aligned with the bowl.

15. A valve member assembly according to claim 11, wherein the float valve member includes a cylindrical guide extending downward towards the opening in the retainer base for receiving the shaft of the check valve member extending through the opening of the retainer base.

16. A valve member assembly for placement in a chamber of a valve body, the chamber extending between a bottom end defining an inlet port and an open top end of the valve body, the valve member assembly comprising:
a) a housing having,
i. a cup including a cup base defining a check valve seat for the inlet port of the valve body, and cup arms extending upwardly from the cup base, ii. a retainer including a retainer base positioned above the cup base and connected to the cup arms, and retainer arms extending upwardly from the retainer base, and iii. a bonnet including, a bonnet base positioned above the retainer base and connected to the retainer arms, the bonnet base defining a float valve seat, and a dome extending from the bonnet base for extending out of the open top end of the valve body when the valve member assembly is placed in the chamber of the valve body, the dome defining at least one vent;

b) a check valve assembly including, i. a check valve member positioned between the cup base and the retainer base and including a shaft slidably extending through an opening in the retainer base, and ii. a check spring positioned between the retainer base and the check valve member, biasing the check valve member against the inlet valve seat, and c) a float valve assembly including, i. a float valve member positioned between the bonnet base and the retainer base, and ii. a float spring positioned between the dome of the bonnet and the float valve member, biasing the float valve member away from the float valve seat, wherein the float valve member includes a cylindrical guide extending downward towards the opening in the retainer base for receiving the shaft of the check valve member extending through the opening of the retainer base.

17. A valve including the valve member assembly of claim 16, and further comprising:

a) a valve body including, an open top end, a bottom end defining an inlet port, a chamber extending from the open top end to the bottom end and connected to the inlet port, an outlet port connected to the chamber through a sidewall of the body;

b) the valve member assembly removably positioned within the chamber of the valve body such that the check valve seat is placed over the inlet port of the valve body and the dome of the bonnet extends out of the open top end of the valve body;

c) a collar removable attached to the open top end of the valve body above the bonnet base to secure the valve member assembly in the chamber of the valve body; and d) a canopy removable attached to the dome of the bonnet.

18. A valve member assembly according to claim 16, wherein the retainer base is releasably connected to the cup arms and the bonnet base is releasably connected to the retainer arms.

19. A valve member assembly according to claim 16, further comprising means for connecting the retainer base to the cup arms and means for connecting the bonnet base to the retainer arms.

* * * * *